US011333094B2

(12) United States Patent
Rodrigues et al.

(10) Patent No.: US 11,333,094 B2
(45) Date of Patent: May 17, 2022

(54) METHOD FOR ESTIMATING THE AGEING OF AN EXHAUST GAS SENSOR AND AN INDUSTRIAL VEHICLE FOR IMPLEMENTING THIS METHOD

(71) Applicant: VOLVO TRUCK CORPORATION, Gothenburg (SE)

(72) Inventors: Patrick Rodrigues, Meyzieu (FR); Benjamin Jacquet, Oullins (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/058,442

(22) PCT Filed: Jun. 6, 2018

(86) PCT No.: PCT/EP2018/064906
§ 371 (c)(1),
(2) Date: Nov. 24, 2020

(87) PCT Pub. No.: WO2019/233577
PCT Pub. Date: Dec. 12, 2019

(65) Prior Publication Data

US 2021/0199065 A1 Jul. 1, 2021

(51) Int. Cl.
*F02D 41/14* (2006.01)
*F02D 41/26* (2006.01)
*F02M 26/46* (2016.01)

(52) U.S. Cl.
CPC ..... *F02D 41/1495* (2013.01); *F02D 41/1454* (2013.01); *F02M 26/46* (2016.02); *F02D 2200/06* (2013.01); *F02D 2200/08* (2013.01)

(58) Field of Classification Search
CPC .. F02D 41/14; F02D 41/1454; F02D 41/1495; F02M 26/46; G06F 15/00
(Continued)

(56) References Cited

U.S. PATENT DOCUMENTS 6,287,453 B1 * 9/2001 Rosel ..... F02D 41/1408 123/688
6,542,853 B1 4/2003 Murakami et al.
(Continued)

FOREIGN PATENT DOCUMENTS

EP 2088417 A1 8/2009
EP 2828510 B1 1/2016
(Continued)

OTHER PUBLICATIONS

International Search Report and Written Opinion dated Feb. 11, 2019 in corresponding International PCT Application No. PCT/EP2018/064906, 10 pages.

*Primary Examiner* — John Kwon
*Assistant Examiner* — Johnny H Hoang
(74) *Attorney, Agent, or Firm* — Venable LLP; Jeffri A. Kaminski

(57) ABSTRACT

A method for estimating the ageing of an exhaust gas sensor (16) placed in an exhaust line (14) of a diesel internal combustion engine (10) of an industrial vehicle (1) includes: —acquiring (S100) an initial value of an estimated remaining lifetime (50) of the exhaust gas sensor; —measuring (S102) the time spent by the engine in each of several predefined engine operation modes during a predefined time period; —for each of the engine operation modes, calculating (S104) a lifetime loss value depending on the time spent by the engine in said engine operation mode during the predefined time period and on a predefined ageing rate associated to said engine operation mode; —updating (S106) the estimated remaining lifetime value by subtracting each calculated lifetime loss value from the initial value.

18 Claims, 6 Drawing Sheets

(58) Field of Classification Search
USPC ..... 701/102, 109, 114, 115; 73/114.18, 73/114.09
See application file for complete search history.

(56) References Cited

U.S. PATENT DOCUMENTS

| | | | | |
|---|---|---|---|---|
| 7,874,285 | B2 * | 1/2011 | Barnikow | F02D 41/2458 123/688 |
| 2002/0060150 | A1 * | 5/2002 | Hashimoto | G01N 27/4175 204/401 |
| 2008/0196387 | A1 * | 8/2008 | Dionnet | F02D 41/0007 60/274 |
| 2009/0013758 | A1 | 1/2009 | Baumann et al. | |
| 2010/0241340 | A1 * | 9/2010 | Weber | F02D 41/1462 701/109 |
| 2012/0053816 | A1 * | 3/2012 | Odendall | F02D 41/2474 701/102 |

FOREIGN PATENT DOCUMENTS

| | | | |
|---|---|---|---|
| GB | 2253957 | A | 9/1992 |
| JP | S593335 | A | 1/1984 |
| WO | 2004095014 | A1 | 11/2004 |
| WO | 2016103398 | A1 | 6/2016 |

* cited by examiner

METHOD FOR ESTIMATING THE AGEING OF AN EXHAUST GAS SENSOR AND AN INDUSTRIAL VEHICLE FOR IMPLEMENTING THIS METHOD

CROSS-REFERENCE TO RELATED APPLICATIONS

This application is a U.S. National Stage application of PCT/EP2018/064906, filed Jun. 6, 2018, and published on Dec. 12, 2019, as WO 2019/233577 A1, all of which is hereby incorporated by reference in its entirety.

TECHNICAL FIELD OF THE INVENTION

The invention relates to a method for estimating the ageing of an exhaust gas sensor placed in an exhaust line of a diesel internal combustion engine of an industrial vehicle. The invention also relates to an industrial vehicle adapted to implement this method. The invention further relates to a predictive maintenance method for said exhaust gas sensor.

BACKGROUND OF THE INVENTION

Exhaust gas sensors, such as oxygen sensor probes, also known as lambda probes, are typically used in vehicles in order to measure the oxygen ratio of exhaust gases released by a diesel internal combustion engine. The measured oxygen ratio provides key information about the operation of the engine. This information is used to control the engine and/or associated emission treatment systems.

A known drawback of lambda probes is that their performance and reliability decreases with time, for example due to the accumulation of combustion byproducts such as particulate matter inside the probe. A degraded lambda probe may cause an improper operation of the vehicle. To avoid this situation, it is desirable to estimate the ageing of the probe in order to be able to replace the probe before it fails.

EP-2,828,510-B1 discloses a method in which the ageing of a lambda probe is estimated based on the frequency response of a measurement signal delivered by the lambda probe in response to a change of oxygen concentration in the exhaust gas. However, this known method is complicated to implement in real time during operation of the vehicle, as it needs to rely on a computer-based physical model of the engine predicting the oxygen concentration.

SUMMARY OF THE INVENTION

The object of the present invention is therefore to provide a method for estimating the ageing of an exhaust gas sensor placed in an exhaust line of a diesel internal combustion engine that is reliable and simple to implement.

To that end, the invention relates to a method for estimating the ageing of an exhaust gas sensor placed in an exhaust line of a diesel internal combustion engine of an industrial vehicle, the method being executed automatically by an electronic control unit of the industrial vehicle, the method including:

- acquiring an initial value of an estimated remaining lifetime of the exhaust gas sensor;
- measuring the time spent by the engine in each of several predefined engine operation modes during a predefined time period;
- for each of the engine operation modes, calculating a lifetime loss value depending on the time spent by the engine in said engine operation mode during the predefined time period and on a predefined ageing rate associated to said engine operation mode;
- updating the estimated remaining lifetime value by subtracting each calculated lifetime loss value from the initial value.

Thanks to the invention, the ageing estimation is simpler to implement than known ageing estimation methods in which complex computer-based physical particulate emission models are implemented in real time by the vehicle, as it involves less complex calculations and requires less computing resources than said known methods According to advantageous aspects, the invention comprises one or more of the features of dependent claims 2 to 12, considered alone or according to all possible technical combinations.

According to another aspect, embodiments of the invention relate to a predictive maintenance method according to claim 13.

According to advantageous aspects, embodiments of the invention comprise one or more of the features of dependent claims 14 and 15, considered alone or according to all possible technical combinations.

According to another aspect, embodiments of the invention relate to a computer program product.

According to still another aspect, embodiments of the invention relate to a computer-readable medium.

According to another aspect, embodiments of the invention relate to an electronic control unit according to claim 18.

According to yet another aspect, embodiments of the invention relate to the industrial vehicle.

BRIEF DESCRIPTION OF THE DRAWINGS

The invention will be better understood upon reading the following description, provided solely as an illustrative example and made in reference to the appended drawings, in which.

DETAILED DESCRIPTION OF SOME EMBODIMENTS

Figure 1:
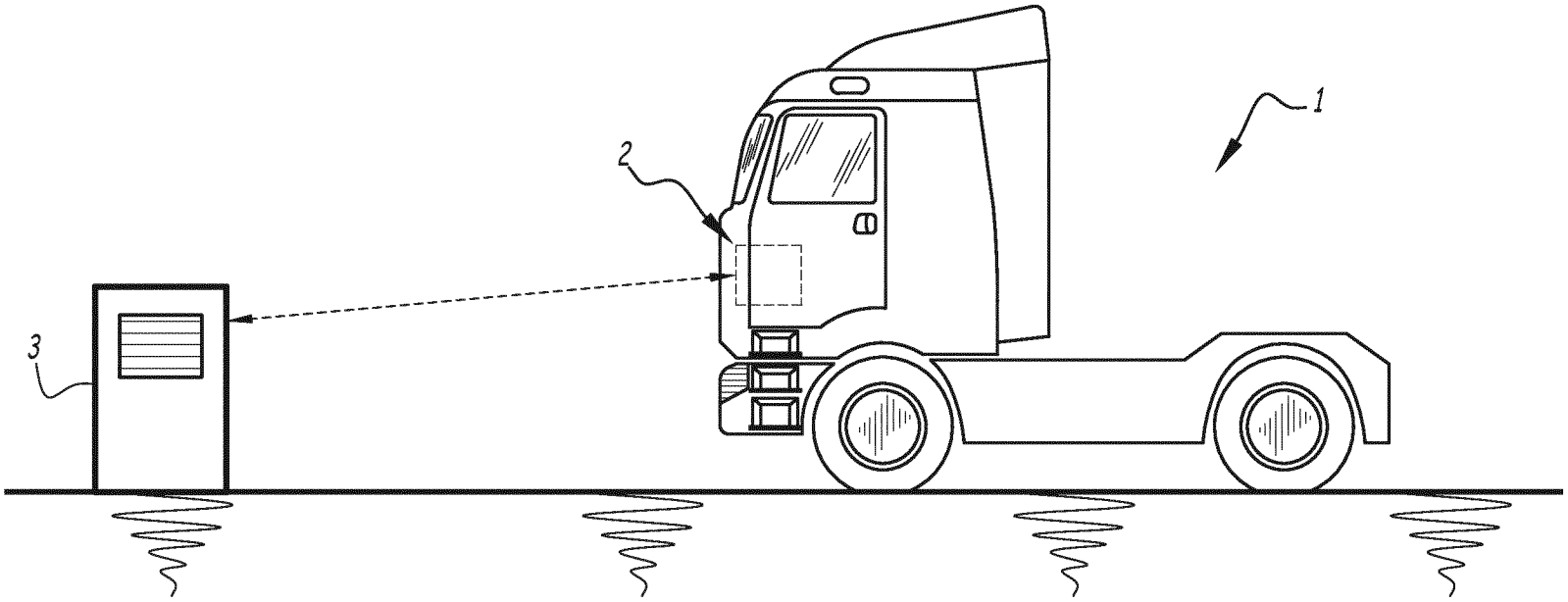
FIG. 1 is a simplified diagram of an industrial vehicle according to the invention.

FIG. 1 illustrates an industrial vehicle 1 comprising an engine system 2. According to preferred embodiments, the vehicle 1 is a semi-trailer truck. In other embodiments, the vehicle 1 can be any industrial vehicle, preferably a wheeled industrial vehicle, such as a tractor, or a dump truck, or a military ground vehicle, or a bus, or a heavy-duty construction vehicle such as a loader, a bulldozer, an excavator, a compactor, a scraper or any equivalent vehicle.

In the illustrated example, the vehicle 1 is shown next to a maintenance workshop device 3 although the device 3 can be omitted.

Figure 2:
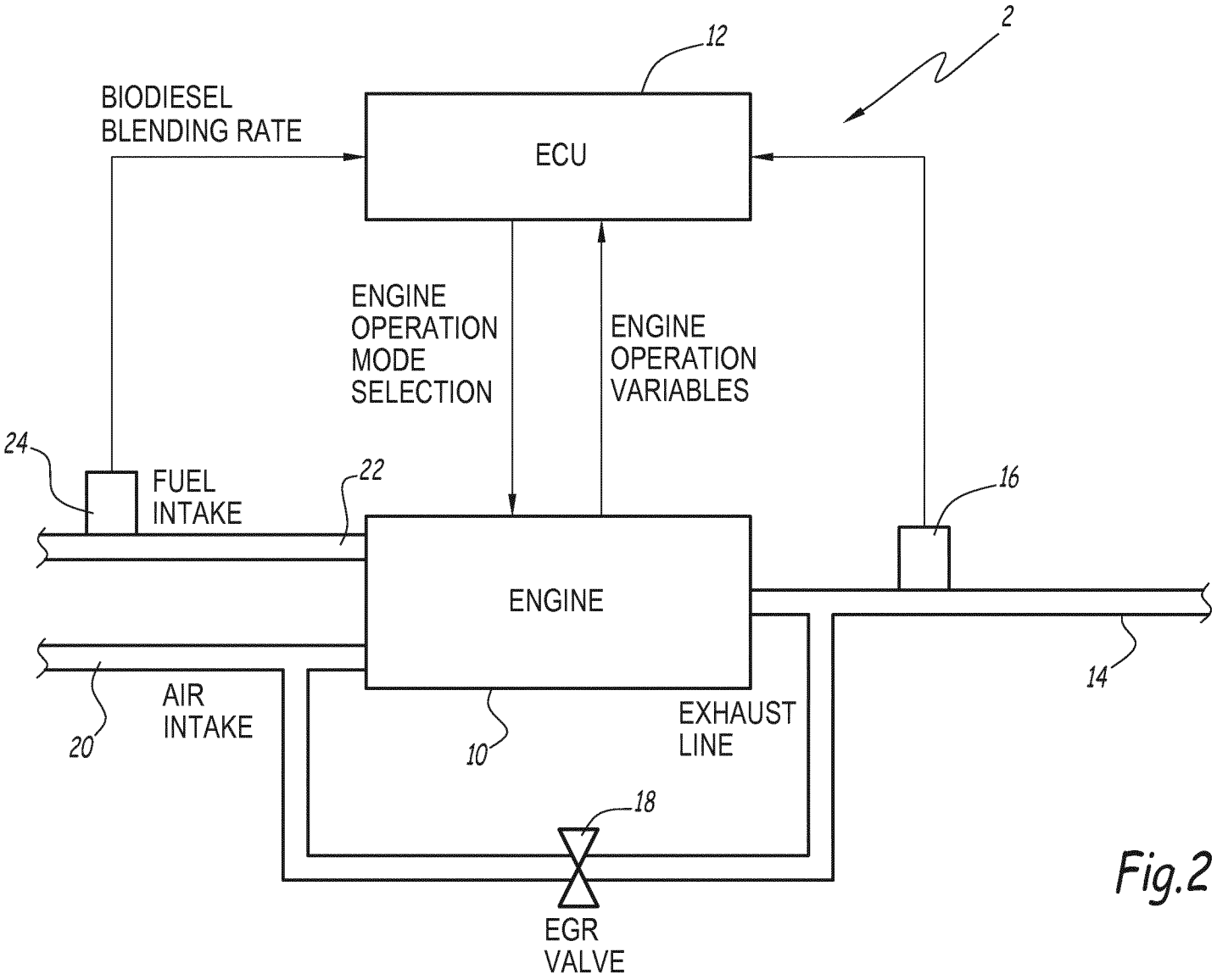
FIG. 2 is a simplified diagram of an engine system of the industrial vehicle of FIG. 1 including an exhaust gas sensor.

As seen on FIG. 2, the engine system 2 includes a diesel internal combustion engine 10, an electronic control unit 12, an exhaust line 14 and an exhaust gas sensor 16.

The engine 10 is adapted to power at least one powertrain of the vehicle 1. The electronic control unit 12, also named engine control unit (ECU), is programmed to control the operation of the engine 10.

The exhaust line 14 is adapted to evacuate exhaust gases and combustion byproducts (such as particulate matter, i.e. soot) generated by the engine 10.

The exhaust gas sensor 16 is installed in the exhaust line 14 to measure the oxygen ratio of the exhaust gases generated by the engine 10 and circulating inside the exhaust line 14. The exhaust gas sensor 16 is operatively coupled to the ECU 12. The exhaust gas sensor 16 is able to send a current value signal proportional to an oxygen ratio in the exhaust line to the ECU 12. The ECU 12 is programmed to calculate the oxygen ratio from the received current value signal.

According to preferred embodiments, the exhaust gas sensor 16 is an oxygen linear sensor probe, also known as a lambda probe. Lambda probes are well known and are not described in detail here.

In many embodiments, the engine system 2 is associated to one or several emission treatment systems, such as an exhaust gas recirculation (EGR) system or a catalytic converter, for mitigating the impact of exhaust gases and combustion byproducts released by the engine 10. Preferably, the emission treatment systems are controlled by the ECU 12.

For example, in some embodiments, an EGR valve 18 is coupled to the exhaust line 14 for recirculating at least a fraction of the exhaust gases towards an air intake manifold (not shown in detail) of the engine 10. Preferably, the EGR valve 18 is placed upstream the exhaust gas sensor 16.

The system 2 also includes an air intake line 20 for supplying fresh air towards the air intake manifold of the engine 10, and a fuel intake line 22 for providing diesel fuel towards the engine 10. The fuel intake line 22 is connected to a fuel tank of the vehicle 1.

In some optional embodiments, the engine 10 is adapted to run on a blend of biodiesel with conventional diesel fuel (i.e. petroleum-based diesel). In practice, users of the vehicle 1 may choose to fill the fuel tank with either conventional diesel or with a blend of conventional diesel and biodiesel. The biodiesel blending rate is defined as the ratio of biodiesel to conventional diesel in the blend. For example, the "B5" fuel is a blend including 5% in volume of biodiesel and 95% in volume of conventional diesel and thus has a blending rate equal to 5%.

In these optional embodiments, the system 2 preferably includes a sensor 24 for measuring the blending rate of biodiesel supplied to the engine 10 through the fuel intake line 22. For example, the sensor 24 is located in the fuel tank or in the fuel intake line 22.

Figure 3:
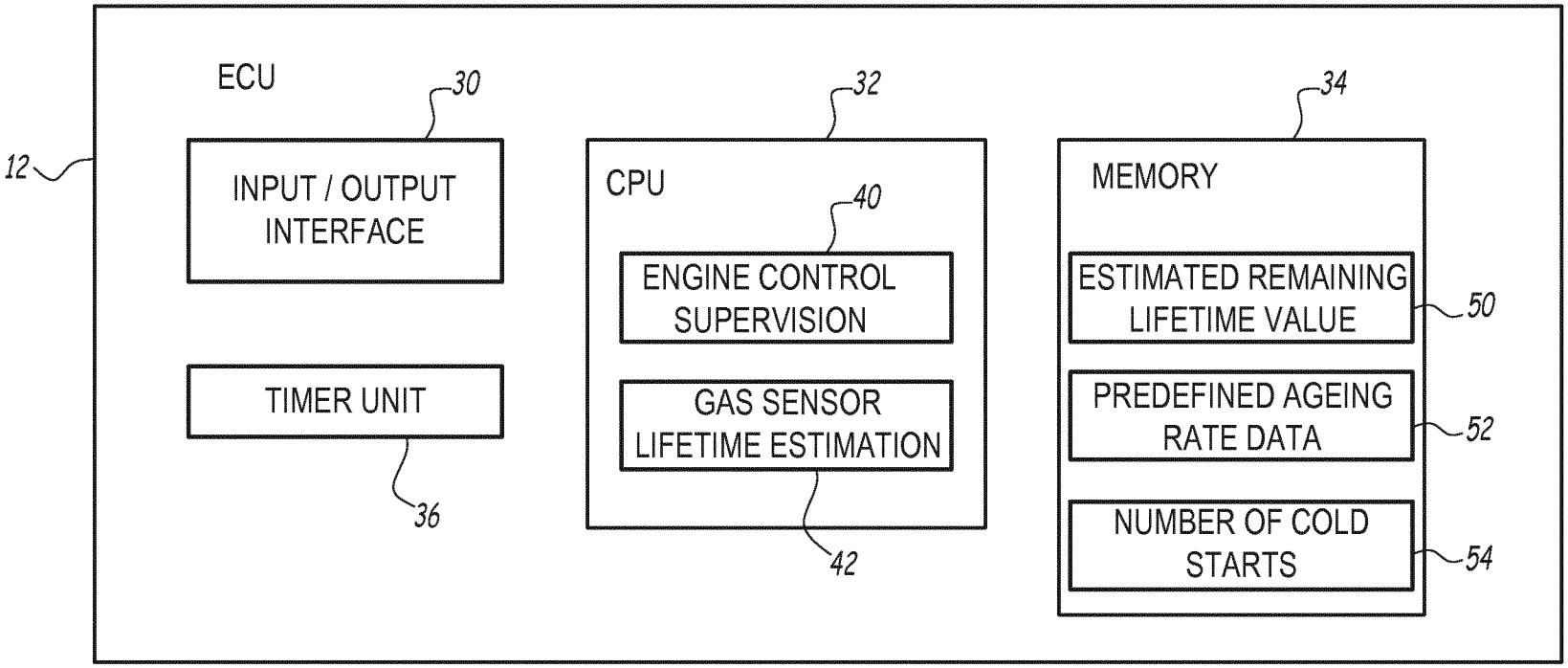
FIG. 3 is a simplified diagram of an electronic control unit of the engine system of FIG. 2.

FIG. 3 schematically illustrates an example of the ECU 12. The ECU 12 includes an input/output interface 30, a central processing unit 32 (CPU), a memory 34 and, preferably, a timer unit 36.

The input/output interface 30 allows the ECU 12 to be operatively coupled to actuators and sensors of the engine system 2, for example through a data exchange link such as a fieldbus, or dedicated cables, or a wireless data link. Preferably, the exhaust gas sensor 16 is connected to the ECU 12 through the interface 30. In the illustrated example, the EGR valve 18 and the sensor 24 are also connected through the interface 30.

The CPU 32 is able to read and modify the contents of the memory 34 and to execute instructions stored in the memory 34. Preferably, the CPU 32 is a programmable microcontroller or a microprocessor.

The memory 34 is a non-volatile computer memory (e.g. a non-transitory computer-readable medium) including one or several memory modules, for example modules of a solid-state storage technology such as Flash memory or any other appropriate data storage technology.

The timer unit 36 may include a digital clock. In some embodiments, the timer unit 36 is implemented by an internal clock of the CPU 12.

In the illustrated example, the ECU 12 is configured to control the operation of the engine 10 using executable instructions 40 stored in the memory 34 and executed automatically by the CPU 32.

In practice, during operation of the engine 10, the ECU 12 is preferably programmed to automatically switch the engine 10 between predefined engine operation modes, depending on the value of measured engine operation variables. Each engine operation mode is associated to predefined reference values (e.g. a set or an interval of reference values) of the engine operation variables. When the measured engine operation variables correspond to the predefined reference values associated to one of the engine operation modes, then the corresponding engine operation mode is selected. The engine operation variables are measured constantly or at least periodically during operation of the engine 10 by sensors of the system 2.

As an illustrative and non-limiting example, the engine operation variables are selected from the group comprising: the fuel consumption rate of the engine 10, the nitrogen oxide gases (NOx) emission rate of the engine 10, the soot emission rate of the engine 10, engine torque mode, after-treatment hydrocarbon injection usage, number of activation/deactivation cycles of a built-in heating element of the sensor 16, and the exhaust gas temperature.

The engine 10 is switched by the ECU 12 into a selected engine operation mode by setting one or several operation parameters of the engine 10 using actuators of the system 2 connected to the ECU 12. Examples of such engine operation parameters include: the amount of injected fuel and the fuel injection timing during each combustion cycle.

Switching the engine 10 between different engine operation modes is a known strategy for optimizing the operation of the engine 10 and reducing the release of exhaust gases and combustion byproducts. For example, if sensors of the system 2 detect that the amount of emitted NOx gases exceeds a predefined limit, then the engine 10 is forcibly switched, at least temporarily, into an engine operation mode where the NOx gases emission rate is much lower.

According to embodiments of the invention, the ECU 12 is also configured to estimate the ageing of the exhaust gas sensor 16 using executable instructions 42 stored in the memory 34 and executed automatically by the CPU 32. For example, executable instructions 42 are part of a computer program product or a computer-readable medium and are meant to implement said method when run on a computer such as the ECU 12.

For example, an estimated remaining lifetime value of the exhaust gas sensor 16 is automatically calculated by the ECU 12 as a function of the time spent by the engine 10 in the various operation modes described above, each operation mode being associated to a predefined ageing rate.

Each predefined ageing rate is representative of the speed with which the exhaust gas sensor 16 degrades (i.e. ages prematurely) when the engine 10 is operating in the corresponding engine operation mode. For example, an operation mode of the engine 10 causing a high emission rate of particulate matter leads to a faster ageing of the exhaust gas sensor 16 and thus is associated to a higher ageing rate than an engine operation mode in which comparatively few particulate matter is released.

In some embodiments, the estimated remaining lifetime value 50 and a set of predefined ageing rate data 52 are stored in the memory 34. The predefined ageing rate data 52 may be stored as a lookup table or any other adequate digital data structure.

Each predefined ageing rate may be calculated beforehand using a theoretical soot model. The soot model links each engine operation mode with a predicted soot emission rate. The ageing rates may also be calculated beforehand using experimental data, for example experimental data obtained by measuring the actual soot emission rate and monitoring the behavior and degradation over time of the exhaust gas sensor 16 in a vehicle 1 operating in real life conditions and/or operating under a controlled test scenario.

The estimated remaining lifetime of the exhaust gas sensor 16 can be expressed in hours or any suitable time unit, or can be expressed as a distance, e.g. in kilometers or in miles. Preferably, the estimated remaining lifetime of the exhaust gas sensor 16 is expressed as a relative value on a predefined scale, the highest value of the scale corresponding to exhaust gas sensor 16 being in a new state (i.e. a factory new exhaust gas sensor). In the illustrated example of FIG. 5, the highest value of the scale is equal to 100% and the lowest value is equal to 0%. The estimated remaining lifetime value can be manually reset to the highest value after replacement of the exhaust gas sensor 16 by a new sensor, e.g. during maintenance operations performed on the vehicle 1.

In practice, the exhaust gas sensor 16 may display a degraded and unsuitable behavior long before reaching the lowest value of the scale. For example, the exhaust gas sensor 16 is considered to be too degraded once the remaining lifetime value is lower than a predefined threshold. As an illustrative example, the threshold may be chosen equal to or lower than 30% or 25% on the predefined scale. The threshold can be set by the manufacturer of by a user of the vehicle 1 (e.g. by a fleet manager).

Figure 4:
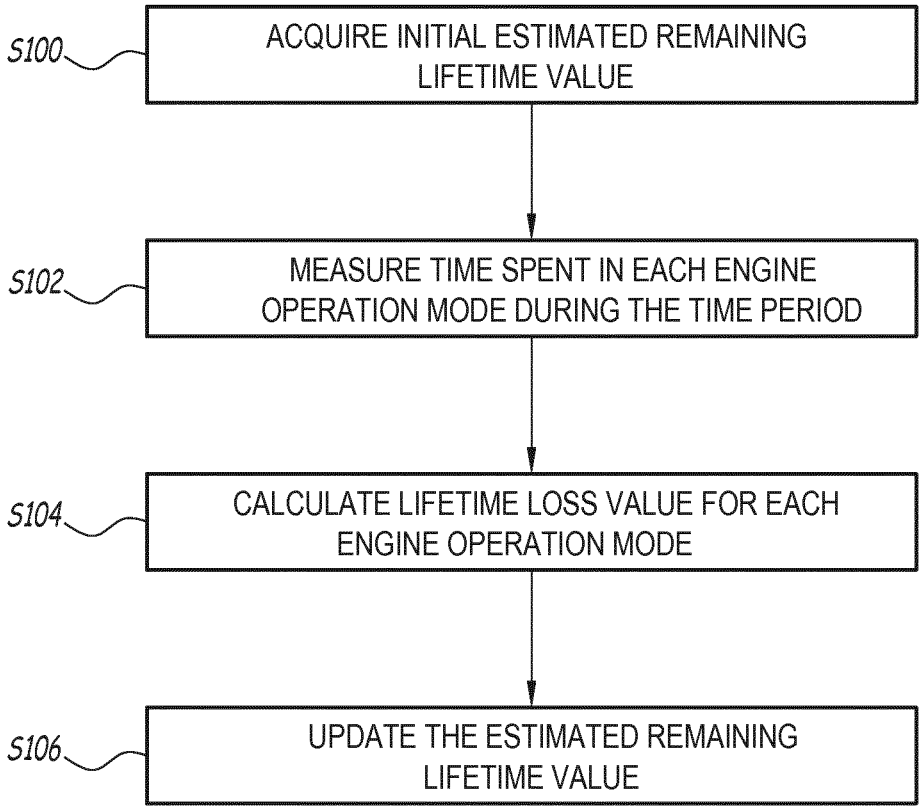
FIG. 4 is a flow chart illustrating a method for estimating the ageing of the exhaust gas sensor of the engine system of FIG. 2.

The flow chart of FIG. 4 illustrates an exemplary embodiment of a method automatically executed by the ECU 12 for estimating the ageing of the exhaust gas sensor 16.

Initially, during a step S100, the ECU 12 acquires an initial value of the estimated remaining lifetime of the exhaust gas sensor 16, for example by reading the current estimated remaining lifetime value 50 from the memory 34.

Then, in a step S102, the ECU 12 measures the time spent by the engine 10 in each of the predefined engine operation modes during a predefined time period ΔT. The time spent by the engine 10 in each operation mode may be counted by the ECU 12 using the timer unit 36.

The time spent by the engine 10 in each engine operation mode (i.e. the duration of each operation mode) may be stored inside memory 34. For example, a time counter is associated to each of the engine operation modes and each of these counters is incremented only when the corresponding operation mode is in use. Indeed, depending on the circumstances, during the time period ΔT, the engine 10 may remain in the same operating mode or may switch between two or more engine operation modes.

According to preferred embodiments, the predefined time period ΔT has a duration more than or equal to one second, or preferably more than or equal to one minute.

Then, during a step S104, a lifetime loss value is calculated for each of the engine operation modes which were active during the time period ΔT. Each lifetime loss value depends on:

- the time spent by the engine 10 in the corresponding engine operation mode during the time period ΔT and
- on a predefined ageing rate associated to said engine operation mode.

As an illustrative and non-limiting example, if the engine 10 spent the time period ΔT switching between a first and a second different engine operation modes, then a first lifetime loss value is calculated based on the total time t1 spent in the first operation mode and on a first predefined ageing rate r1 associated to the first operation mode, and a second lifetime loss value is calculated based on the total time t2 spent in the second operation mode and on a second predefined ageing rate r2 associated to the second operation mode.

For example, the predefined ageing rate values are fetched by the CPU 32 from the set of predefined ageing rate data 52 stored in the memory 34.

Each lifetime loss value is calculated by multiplying the time spent t1 or t2 by the engine in the engine operation mode during the time period ΔT with the predefined ageing rate, respectively r1 or r2, associated to the corresponding engine operation mode.

Finally, during a step S106, the estimated remaining lifetime value is updated by subtracting each calculated lifetime loss value from the initial value. The updated value may be stored in the memory 34 in place of the remaining lifetime value 50.

In practice, the method is preferably reiterated continuously during operation of the engine 10. In many embodiments, the steps S102, S104 and S106 described above are reiterated for each one of a plurality of successive time periods ΔT, meaning that in some circumstances several instances of the method may be running at a given moment.

One therefore understands that the remaining lifetime value is estimated recursively by decreasing the previously estimated remaining lifetime value by an amount which is representative of the predicted degradation of the exhaust gas sensor 16 caused by the operation of the engine 10 in the corresponding operation modes during the time period ΔT.

This method is simpler to implement than known ageing estimation methods in which complex computer-based physical particulate emission models are implemented in real time by the vehicle, as it involves less complex calculations and requires less computing resources than known methods. The use of the ageing rate data also allows for a more precise estimation of the degradation of the exhaust gas sensor 16. The ageing method can also be easily personalized by the users of the vehicle 1 by modifying the way the estimated remaining lifetime is calculated, for example by updating the ageing rate values e.g. in order to take into account specific uses of the vehicle 1 (e.g. if the vehicle 1 is predominantly used in urban settings or for long-distance trips on highways). Changing the ageing rate values 52 recorded in memory 34 is simpler to do than modifying a physical emission model.

According to advantageous alternative embodiments, the lifetime loss values calculated during step S104 are corrected by one or several correction coefficients depending on variables representative of the usage history of the engine 10 and/or of measured operation variables of the engine 10. This correction may be applied during step S104.

For example, the correction of a calculated lifetime loss value by a correction coefficient may include: multiplying the calculated lifetime loss value with a numerical factor depending on said correction coefficient, or adding an offset depending on said correction coefficient to the calculated lifetime loss value, or modifying the calculated lifetime loss value using a predefined mathematical function having said correction coefficient as a parameter (e.g. a power law having said correction coefficient as exponent), or any combination thereof.

According to some example embodiments, the correction coefficients may depend:

- on a blending rate of biodiesel in the fuel supplied to the engine 10, such as the blending rate measured by the sensor 24;
- on the opening rate of the EGR valve 18 (i.e. the ratio of the open cross section area to the total cross section area of the EGR valve);
- on the soot emission rate of the engine 10, for example estimated by a model or measured by a particle concentration sensor placed in the exhaust line 14, preferably placed in a catalytic converter placed downstream the exhaust line 14;
- on the number of cold starts of the engine 10, this number of cold starts being advantageously recorded in memory 34 in a counter 54 (FIG. 3);
- on the output torque provided by the engine 10.

According to different alternative embodiments, the lifetime loss values may be corrected using any combination of the above correction coefficients. The applied correction may be different from one operation engine mode to another and/or from a time period ΔT to another. The corrections above are optional and may be omitted.

An advantage of applying such corrections is that the reliability of the estimated remaining lifetime value is increased, by taking into account many factors which may accelerate the ageing of the sensor 16. For example, the fuel quality and especially the presence of biodiesel may lead to a different soot emission rate than if only conventional diesel was used. According to another example, when the engine is cold started, there is often condensed water trapped in the exhaust line 14 which may damage the sensor 16.

Figure 5:
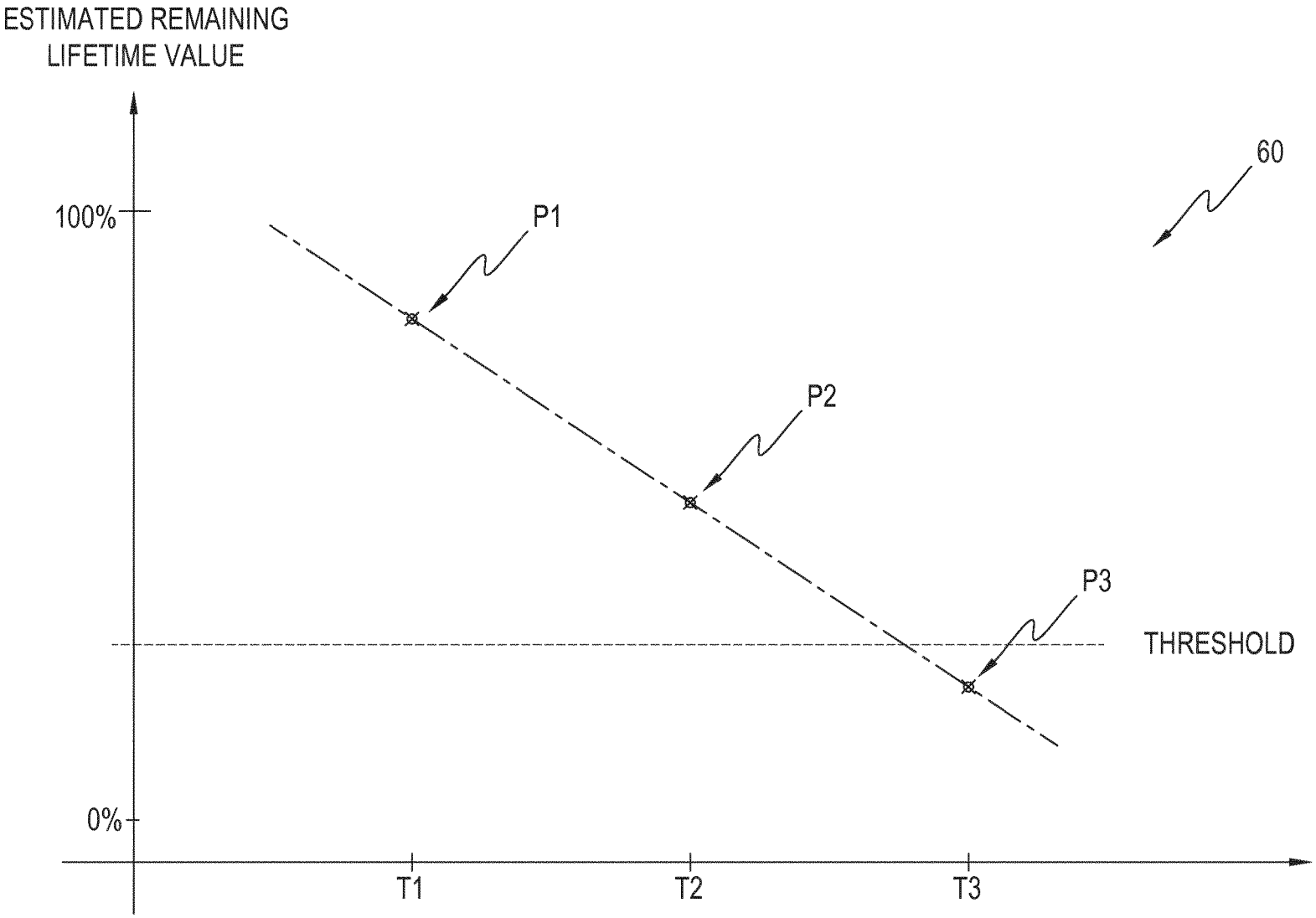
FIG. 5 is a graph illustrating an example of the evolution of the estimated remaining lifetime value of the exhaust gas sensor of the engine system of FIG. 2.
Figure 6:
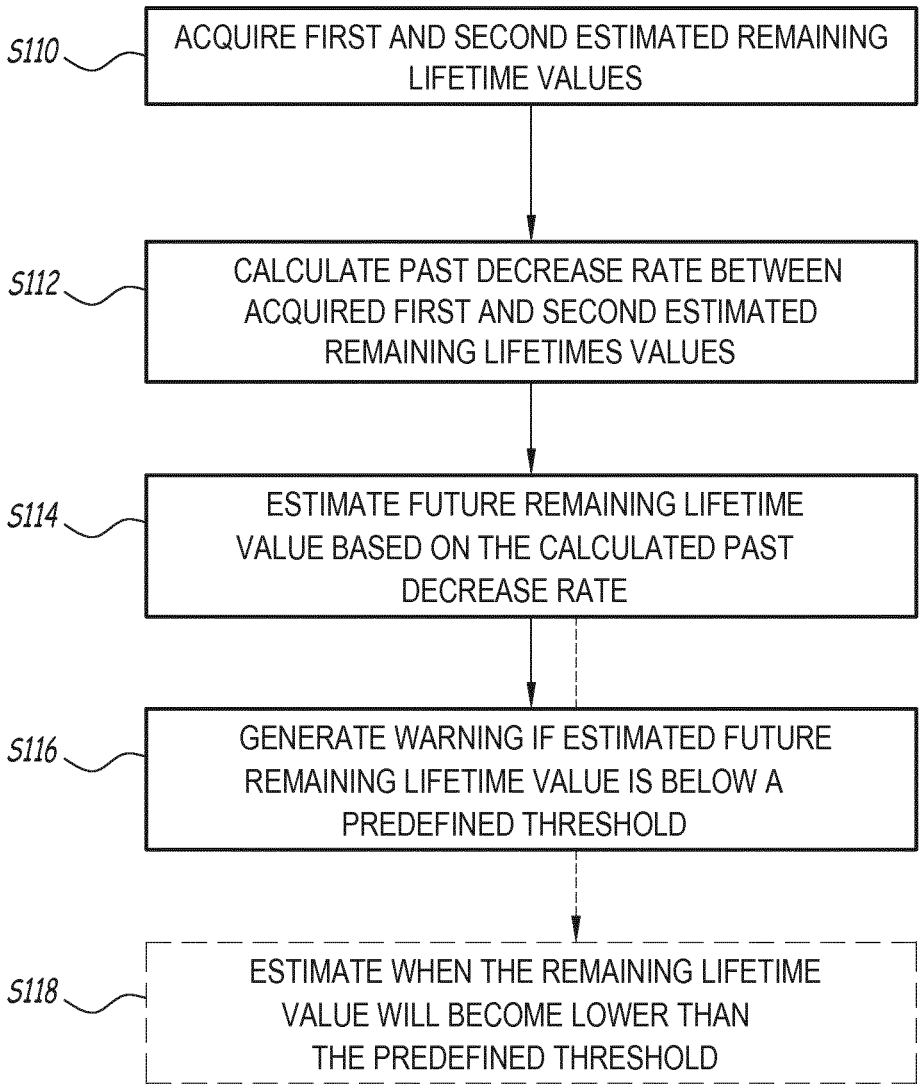
FIG. 6 is a flow chart illustrating a predictive maintenance method for the exhaust gas sensor of the engine system of FIG. 2.

Turning now to FIGS. 5 and 6, a predictive maintenance method of the exhaust gas sensor 16 based on the above embodiments is described. This predictive maintenance method is preferably implemented automatically using the maintenance workshop device 3. For example the device 3 is connected to the ECU 12 using a data exchange link such as an on-board diagnostics (ODB) connector. According to other embodiments, the method may be implemented automatically by the ECU 12.

FIG. 5 illustrates a graph 60 depicting the evolution of the estimated remaining lifetime value of the exhaust gas sensor 16 at different operating times of the engine 10. For example, the operating time can be expressed as a number of operating hours of the engine 10 since the last replacement of the sensor 16. Alternatively, the operating time may correspond to the distance (in miles or kilometers) ran by the vehicle 1 from the last replacement of the sensor 16. The three points P1, P2 and P3 correspond to estimated remaining lifetime values at three operating time values T1, T2 and T3 respectively. The estimated remaining lifetime values can be converted into time values or into distance values, for example using predefined conversion tables.

The flow chart of FIG. 6 illustrates an exemplary embodiment of this predictive maintenance method.

During a first step S110, a first remaining lifetime value of the exhaust gas sensor 16 (corresponding to point P2) at a first engine operating time value T2 and at least one second remaining lifetime value (corresponding to point P1) of the same exhaust gas sensor 16 at a second engine operating time value T1 are acquired. The second engine operating time value T1 is older (i.e. lower) than the first engine operating time value T2. T1 and T2 may correspond to successive maintenance operations at a maintenance workshop. Both first and second remaining lifetime values P2, P1 are estimated using the method described above. For example, the first remaining lifetime value P2 corresponds to a present value estimated when the vehicle is currently stop T2 for a maintenance operation at a maintenance workshop and the second remaining lifetime value P1 corresponds to a past value of the remaining lifetime value estimated when the vehicle was stop T1 for a previous maintenance operation at the maintenance workshop, although other embodiments are possible. For instance, P1 and P2 can be estimated onboard the vehicle at different engine operating time values T1 and T2 when the vehicle is not necessary stop for maintenance operations.

Then, during a S112, the past decrease rate of the remaining lifetime value for a past time interval between the first and second engine operating time values T1, T2 is calculated.

During a further step S114, a future remaining lifetime value (corresponding to point P3) at a third engine operating time value T3 is estimated, by extrapolating a future decrease rate of the remaining lifetime value at a future time interval between the second and third values, the extrapolation being based on the estimated past decrease rate.

For example, T3 can correspond to a next planned maintenance operation and the past time interval and the future time interval correspond to planned maintenance intervals of the vehicle.

Finally, during a step S116, a warning is generated if the estimated future remaining lifetime value is lower than a predefined threshold (i.e. the threshold value below which the exhaust gas sensor 16 is deemed to be too degraded). In some embodiments, the warning is generated by a human-machine interface of the device 3. In some other embodiments the warning is generated by a human-machine interface of the vehicle 1. For instance, if the estimated future remaining lifetime value at the time of the next planned maintenance operation is lower than a predefined threshold, the warning message can advise the driver or user to replace the exhaust gas sensor 16 during the actual maintenance operation T2 as a preemptive replacement and in order to avoid immobilizing once more the vehicle before next planned maintenance operation.

In some embodiments, the method further includes a step S118 of estimating the future engine operating time value for which the remaining lifetime of the exhaust gas sensor 16 becomes lower than the predefined threshold, based on the estimated past decrease rate.

The predictive maintenance method facilitates the maintenance of the vehicle 1, by indicating to users of the vehicle 1 (such as a maintenance operator and/or a fleet manager) whether the exhaust gas sensor 16 is likely to last until the next planned maintenance operation of the vehicle 1 or if a preemptive replacement is needed.

If the future predicted remaining lifetime value is lower than the threshold, then a preemptive replacement of the exhaust gas sensor 16 is preferable in order to avoid failure or malfunction and intermediate maintenance operation where the vehicle is immobilized. If the future predicted remaining lifetime value is higher than the threshold, a replacement is not necessary as it can be postponed until the next scheduled maintenance visit.

This is more economical than known maintenance methods in which the exhaust gas sensor 16 is preemptively and systematically replaced based solely on theoretical maximal lifetime values given by the manufacturer, even though the sensor has only undergone limited ageing and is potentially able to last longer. This is because these theoretical lifetime values are averages which may not always correspond to the actual past use of the vehicle 1. On the contrary, the estimated remaining lifetime values obtained using the above method are more accurate, since they take into account how the engine 10 was actually used.

The embodiments and alternatives described above may be combined with each other in order to generate new embodiments of the invention.

The invention claimed is:

1. A method for estimating an ageing of an exhaust gas sensor placed in an exhaust line of a diesel internal combustion engine of an industrial vehicle, the method being executed automatically by an electronic control unit of the industrial vehicle, wherein the method includes:

acquiring an initial value of an estimated remaining lifetime of the exhaust gas sensor;

measuring a duration time spent by the engine in each of several predefined engine operation modes during a predefined time period;

for each of said several predefined engine operation modes, calculating a lifetime loss value depending on a duration time spent by the engine in said engine operation mode during the predefined time period and on a predefined ageing rate associated to said engine operation mode;

updating the estimated remaining lifetime value by subtracting each calculated lifetime loss value from the initial value, wherein the calculated lifetime loss values are corrected by a correction coefficient depending on the opening rate of an exhaust gas recirculation valve placed in the exhaust line.

2. The method according to claim 1, wherein the engine is automatically switched between the predefined engine operation modes based on measured values of engine operation variables, each engine operation mode being associated to predefined reference values of the engine operation variables, each engine operation mode being selected when the measured engine operation variables correspond to the predefined reference values associated to this engine operation mode.

3. The method according to claim 2, wherein the engine operation variables are selected from the group comprising: a consumption rate of the engine, a nitrogen oxide gases emission rate of the engine, a soot emission rate of the engine.

4. The method according to claim 1, wherein the calculated lifetime loss values are corrected by a correction coefficient depending on a blending rate of biodiesel in the fuel consumed by the engine.

5. The method according to claim 1, wherein the calculated lifetime loss values are corrected by a correction coefficient depending on a soot emission rate of the engine.

6. The method according to claim 1, wherein the calculated lifetime loss values are corrected by a correction coefficient depending on a number of cold starts of the diesel internal combustion engine.

7. The method according to claim 1, wherein each predefined ageing rate is calculated beforehand using a theoretical soot model linking the engine operation mode with a predicted soot emission rate or using experimental data obtained by measuring an actual soot emission rate and monitoring the behavior and degradation over time of the exhaust gas sensor in a vehicle operating in real life conditions or operating under a controlled test scenario.

8. The method according to claim 1, wherein the lifetime loss value is calculated for any engine operation mode by multiplying the time spent by the engine in the engine operation mode during the predefined time period with the predefined ageing rate associated to the engine operation mode.

9. The method according to claim 1, wherein the method is reiterated continuously during operation of the engine.

10. The method according to claim 1, wherein the predefined time period having a duration more than or equal to one second, or preferably more than or equal to one minute.

11. The method according to claim 1, wherein the estimated remaining lifetime is expressed as a relative value on a predefined scale, the highest value of the scale corresponding to an exhaust gas sensor being in a new state.

12. The method according to claim 1, wherein each predefined ageing rate is calculated beforehand using a theoretical soot model linking the engine operation mode with a predicted soot emission rate and using experimental data obtained by measuring an actual soot emission rate and monitoring the behavior and degradation over time of the exhaust gas sensor in a vehicle operating in real life conditions and operating under a controlled test scenario.

13. An electronic control unit for automatically executing a method for estimating the ageing of an exhaust gas sensor of an industrial vehicle, the electronic control unit being configured to perform the method of claim 1.

14. An industrial vehicle comprising a diesel internal combustion engine, an exhaust gas sensor placed in an exhaust line of the diesel internal combustion engine and an electronic control unit, wherein the electronic control unit is according to claim 13.

15. A predictive maintenance method for an exhaust gas sensor placed in an exhaust line of a diesel internal combustion engine of an industrial vehicle, wherein the method includes: acquiring a first remaining lifetime value of an exhaust gas sensor at a first engine operating time value and at least one second remaining lifetime value of the same exhaust gas sensor at a second engine operating time value older than the first operating time value, the remaining lifetime values being estimated using a method according to claim 1; calculating the past decrease rate of the remaining lifetime value for a past time interval between the first and second operating time values; estimating a third remaining lifetime value at a third engine operating time value, by extrapolating a future decrease rate of the remaining lifetime value at a future time interval between the second and third operating time values, the extrapolation being based on the estimated past decrease rate; generating a warning if the estimated future remaining lifetime value is lower than a predefined threshold.

16. The method of claim 15, wherein the past time interval and the future time interval correspond to planned maintenance intervals of the engine.

17. The method of claim 15, wherein the method further includes estimating the future engine total operating time value for which the remaining lifetime of the exhaust gas sensor becomes lower than the predefined threshold, based on the estimated, past decrease rate.

18. A method for estimating an ageing of an exhaust gas sensor placed in an exhaust line of a diesel internal combustion engine of an industrial vehicle, the method being executed automatically by an electronic control unit of the industrial vehicle, wherein the method includes:

acquiring an initial value of an estimated remaining lifetime of the exhaust gas sensor;

measuring a duration time spent by the engine in each of several predefined engine operation modes during a predefined time period;

for each of said engine operation modes, calculating a lifetime loss value depending on a duration time spent by the engine in said engine operation mode during the predefined time period and on a predefined ageing rate associated to said engine operation mode;

updating the estimated remaining lifetime value by subtracting each calculated lifetime loss value from the initial value, wherein the engine is automatically switched between the predefined engine operation modes based on measured values of engine operation variables, each engine operation mode being associated to predefined reference values of the engine operation variables, each engine operation mode being selected when the measured engine operation variables correspond to the predefined reference values associated to this engine operation mode, wherein at least two engine operation variables are selected from the group comprising: the consumption rate of the engine, the nitrogen oxide gases emission rate of the engine, the soot emission rate of the engine.

* * * * *